US010163547B2

(12) United States Patent
Hayakawa et al.

(10) Patent No.: US 10,163,547 B2
(45) Date of Patent: Dec. 25, 2018

(54) LINEAR FILLER PADDED COMPOSITE CABLE

(71) Applicant: Hitachi Metals, Ltd., Minato-ku, Tokyo (JP)

(72) Inventors: Yoshikazu Hayakawa, Tokyo (JP); Tomoyuki Murayama, Tokyo (JP); Hirotaka Eshima, Tokyo (JP); Sachio Suzuki, Tokyo (JP); Hiroyuki Ito, Tokyo (JP); Takahiro Futatsumori, Tokyo (JP); Noriyuki Takahashi, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/933,171

(22) Filed: Mar. 22, 2018

(65) Prior Publication Data

US 2018/0286538 A1 Oct. 4, 2018

(30) Foreign Application Priority Data

Mar. 31, 2017 (JP) ..... 2017- 070775

(51) Int. Cl.

| | |
|---|---|
| ***H01B 9/00*** | (2006.01) |
| ***H01B 7/18*** | (2006.01) |
| ***H01B 7/00*** | (2006.01) |
| ***H01B 7/02*** | (2006.01) |
| ***H01B 11/02*** | (2006.01) |
| ***H01B 11/10*** | (2006.01) |

(52) U.S. Cl.

CPC ..... *H01B 9/003* (2013.01); *H01B 7/0009* (2013.01); *H01B 7/0216* (2013.01); *H01B 7/1875* (2013.01); *H01B 11/02* (2013.01); *H01B 11/10* (2013.01); *H01B 7/0241* (2013.01)

(58) Field of Classification Search

None

See application file for complete search history.

(56) References Cited

U.S. PATENT DOCUMENTS

2007/0011667 A1* 1/2007 Subbiah ..... G06F 9/52 717/148

2007/0107921 A1* 5/2007 Morrison ..... H01B 9/02 174/36

(Continued)

FOREIGN PATENT DOCUMENTS

JP 2006-351322 A 12/2006

*Primary Examiner* — Dimary Lopez Cruz
*Assistant Examiner* — Muhammed Azam
(74) *Attorney, Agent, or Firm* — Crowell & Moring LLP

(57) ABSTRACT

A composite cable includes: a plurality of first electric wires; a shield wire including a twisted wire in which a plurality of second electric wires are twisted together and a shield layer provided on an outer periphery of the twisted wire, each of the second electric wires having an outer diameter smaller than each of the first electric wires; a sheath provided on an outer periphery of an electric wire bundle in which the plurality of first electric wires and the shield wire are twisted together; a plurality of first linear fillers filled between the twisted wire and the shield layer; and a plurality of second linear fillers filled between the electric wire bundle and the sheath, wherein each of the first linear fillers and each of the second linear fillers are a same type of linear filler, and a fill ratio of the first linear fillers is greater than a fill ratio of the second linear fillers.

8 Claims, 3 Drawing Sheets

(56) References Cited

U.S. PATENT DOCUMENTS

| | | | | |
|---|---|---|---|---|
| 2007/0110376 | A1* | 5/2007 | Buthe | G02B 6/4416 385/123 |
| 2007/0184689 | A1* | 8/2007 | Tanaka | A61B 8/00 439/86 |
| 2010/0025072 | A1* | 2/2010 | Okano | H01B 11/1008 174/115 |
| 2012/0168199 | A1* | 7/2012 | McCullough | H01B 7/14 174/113 R |
| 2013/0077924 | A1* | 3/2013 | Shin | G02B 6/4416 385/101 |
| 2015/0187463 | A1* | 7/2015 | Jin | H01B 9/005 385/101 |
| 2015/0200040 | A1* | 7/2015 | Pon | H01B 11/00 174/103 |
| 2017/0264063 | A1* | 9/2017 | Hayakawa | H01R 31/005 |
| 2017/0287590 | A1* | 10/2017 | Hayakawa | B60R 16/0231 |

* cited by examiner

LINEAR FILLER PADDED COMPOSITE CABLE

CROSS-REFERENCE TO RELATED APPLICATION

The present application claims priority from Japanese Patent Application No. 2017-70775 filed on Mar. 31, 2017, the content of which is hereby incorporated by reference into this application.

TECHNICAL FIELD OF THE INVENTION

The present invention relates to a composite cable that includes at least two different types of electric wires.

BACKGROUND OF THE INVENTION

A composite cable having a bundle of electric wires (hereinafter occasionally referred to as "electric wire bundle") and a sheath layer provided on an outer periphery of this electric wire bundle is conventionally known, the electric wires having two power cables and two signal lines twisted together. In other words, a composite cable having a bundle of four electric wires covered by a sheath layer is conventionally known. Each of the signal lines included in the above-described electric wire bundle comprises two signal lines twisted together, and a shield layer is provided on an outer periphery of the two signal lines twisted together (Patent Document 1: Japanese Patent Application Laid-Open Publication No. 2006-351322).

SUMMARY OF THE INVENTION

Generally, in the composite cable described in Patent Document 1 and other composite cables, fillers are provided between the electric wire bundle and the sheath layer to maintain a circular cross-sectional shape of the composite cable.

However, if the fillers are provided between the electric wire bundle and the sheath layer, a shield layer provided on an outer periphery of the two signal lines is subject to pressure of the fillers and is crushed, occasionally causing a cross-sectional shape of the shield layer to become non-circular. Further, if the composite cable is bent in a state where the cross-sectional shape of the shield layer, which should be circular in nature, is deformed into a non-circular shape, the shield layer may be damaged. In particular, the shield layer may be able to avoid damage when the composite cable is bent for the first time, but has a high possibility of being ultimately damaged if the composite cable is repeatedly bent in the state where the cross-sectional shape of the shield layer is deformed.

As described above, the conventional composite cable has a problem in which the cross-sectional shape of the shield layer provided on the outer periphery of the signal lines is subject to deformation by the fillers that maintain the circular cross-sectional shape of the entire composite cable.

The present invention has been made in view of the problem described above, and its object is to suppress deformation of the cross-sectional shape of the shield layer provided on the outer periphery of the signal lines while maintaining the cross-sectional shape of the composite cable.

According to the present invention, a composite cable comprises: a plurality of first electric wires; a shield wire including a twisted wire in which a plurality of second electric wires are twisted together and a shield layer provided on an outer periphery of the twisted wire, each of the second electric wires having an outer diameter smaller than each of the first electric wires; a sheath provided on an outer periphery of a bundle in which the plurality of first electric wires and the shield wire are twisted together; a plurality of first linear fillers filled between the twisted wire and the shield layer; and a plurality of second linear fillers filled between the bundle and the sheath, wherein each of the first linear fillers and each of the second linear fillers are a same type of linear filler, and a fill ratio of the first linear fillers is greater than a fill ratio of the second linear fillers.

According to one aspect of the present invention, the plurality of second linear fillers, the plurality of first electric wires and the shield wire are twisted together, and the plurality of first linear fillers and the plurality of second electric wires are twisted together.

According to another aspect of the present invention, each of the first linear fillers and each of the second linear fillers have equal cross-sectional areas, and the number of first linear fillers per unit cross-sectional area is greater than the number of second linear fillers per unit cross-sectional area.

According to another aspect of the present invention, the plurality of first electric wires are in direct contact with the plurality of second linear fillers.

According to the present invention, it is possible to suppress deformation of the cross-sectional shape of the shield layer provided on the outer periphery of the signal lines while maintaining the cross-sectional shape of the composite cable.

BRIEF DESCRIPTIONS OF THE DRAWINGS

DESCRIPTIONS OF THE PREFERRED EMBODIMENTS

Next, an example according to an embodiment of the present invention will be described. A composite cable according to the present embodiment is a composite cable partially constituting a complex harness utilized in a vehicle such as an automobile, and an electric wire for supplying power to an electric motor which is a driving source for an electro-mechanical brake unit (EMB power cable) and an electric wire for transmitting signals to control the electro-mechanical brake unit (CAN signal line) are integrated by a single sheath. A structure of the composite cable according to the present embodiment will be described in detail below.

Figure 1:
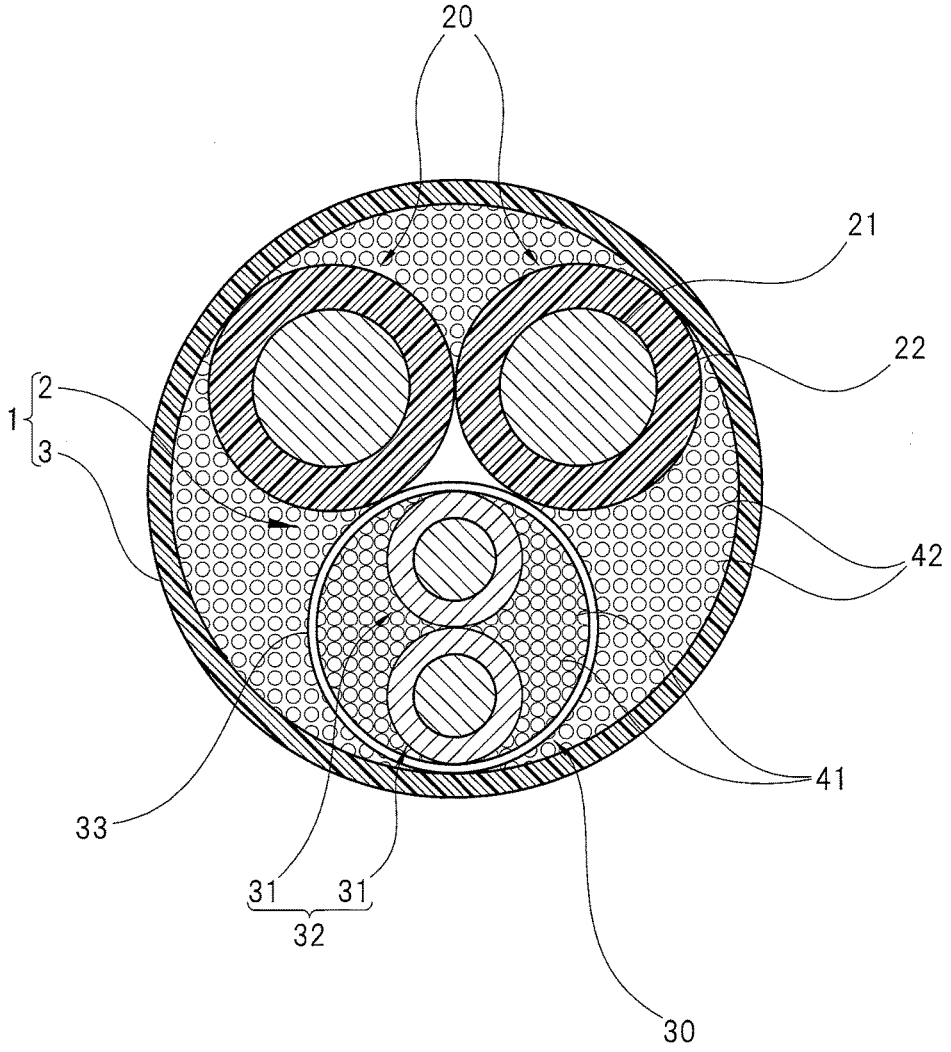
FIG. 1 is a cross-sectional view showing an example of a composite cable to which the present invention is applied.

As shown in FIG. 1, the composite cable 1 according to the present embodiment has a bundle 2 of electric wires and a sheath 3 provided on an outer periphery of the bundle 2, and the composite cable 1 has an outer diameter of 8 mm to 12 mm. The bundle 2 includes a plurality of first electric wires 20 (two in the present embodiment) and a shield wire 30, and the first electric wires 20 and the shield wire 30 are twisted together. In the description below, the bundle 2 is occasionally referred to as "electric wire bundle 2". In addition, the sheath 3 of the present embodiment is formed of polyurethane.

Each of the first electric wires 20 partially constituting the electric wire bundle 2 is a power cable for supplying power to the electric motor that is the driving source for the electro-mechanical brake unit. Each of the first electric wires 20 has a core wire 21 in which several copper wires or copper alloy wires are twisted together and an insulation 22 covering the core wire 21. The core wire 21 has a diameter of 0.08 mm to 0.12 mm, and the insulation 22 is formed of crosslinked polyethylene. In the present embodiment, the two first electric wires 20 are in contact with each other.

The shield wire 30 partially constituting the electric wire bundle 2 has a twisted wire 32 in which a plurality of second electric wires 31 are twisted together and a shield layer 33 provided on an outer periphery of this twisted wire 32, and each of the second electric wires has an outer diameter smaller than each of the first electric wires 20. The twisted wire 32 of the present embodiment is constituted by two second electric wires 31 twisted together. Each of the second electric wires 31 is a CAN signal line for transmitting signals to control the electro-mechanical brake unit. In the description below, the twisted wire 32 is occasionally referred to as "twisted-pair wire 32". In other words, the shield wire 30 of the present embodiment has the twisted-pair wire 32 and the shield layer 33 provided on the outer periphery of this twisted-pair wire 32. Note that the second electric wires 31 have a same basic structure as the first electric wires 20. Namely, each of the second electric wires 31 has a core wire in which several copper wires or copper alloy wires are twisted together and an insulation covering the core wire. In the present embodiment, the two second electric wires 31 are in contact with each other. In addition, in the present embodiment, the shield wire 30 is in contact with the two first electric wires 20 in a state where a portion of the shield wire 30 is arranged in a valley portion between the two first electric wires 20. Note that a press-winding comprising a non-woven fabric tape or a paper tape may be provided on an outer periphery of the shield wire 30 such that the press-winding is in contact with the shield layer 33. Hence, it is effective in that damage to the insulation 22 caused by the first electric wires 20 and the shield layer 33 being in contact with each other can be suppressed.

The shield wire 30 has a plurality of first linear fillers 41 in addition to the twisted-pair wire 32 and the shield layer 33. In other words, the plurality of first linear fillers 41 are filled between the twisted-pair wire 32 and the shield layer 33. In the present embodiment, the twisted-pair wire 32 and some of the first linear fillers 41 are in contact with an inner circumference of the shield layer 33. On the other hand, a plurality of second linear fillers 42 are filled between the electric wire bundle 2 and the sheath 3. In other words, the composite cable 1 has the plurality of first linear fillers 41 filled between the twisted-pair wire 32 and the shield layer 33, and the plurality of second linear fillers 42 filled between the electric wire bundle 2 and the sheath 3. Note that a press-winding comprising a non-woven fabric tape or a paper tape may be provided between the shield layer 33 and a bundle that includes the twisted-pair wire 32 and the first linear fillers 41 such that the press-winding is in contact with the twisted-pair wire 32, some of the first linear fillers 41 and the inner circumference of the shield layer 33. Hence, it is effective in that the shield layer 33 can be easily provided on the outer periphery of the bundle that includes the twisted-pair wire 32 and the first linear fillers 41 while damage to the insulation of the second electric wires 31 caused by the second electric wires 31 and the shield layer 33 being in contact with each other can be suppressed.

Each of the first linear fillers 41 included in the shield wire 30 is a yarn formed of polyethylene, PET (polyethylene terephthalate) or PP (polypropylene), and the first linear fillers 41 are twisted together with the plurality of second electric wires 31. In addition, each of the second linear fillers 42 is a yarn formed of polyethylene, PET (polyethylene terephthalate) or PP (polypropylene), and the second linear fillers 42 are twisted together with the plurality of first electric wires 20 and the shield wire 30. In other words, the first linear fillers 41 and the second linear fillers 42 are a same type of linear filler. However, a fill ratio of the first linear fillers 41 is greater than a fill ratio of the second linear fillers 42. In other words, a cross-sectional area of the plurality of first linear fillers 41 is higher in density than a cross-sectional area of the plurality of second linear fillers 42, and the cross-sectional area of the plurality of second linear fillers 42 is lower in density than the cross-sectional area of the plurality of first linear fillers 41. Note that, in the present embodiment, the second linear fillers 42 are not provided in a gap formed between the two first electric wires 20 and the shield wire 30.

Here, the first linear fillers 41 and the second linear fillers 42 being the "same type" means not only that the materials are the same (polyethylene), but also that each of the first linear fillers 41 and each of the second linear fillers 42 have equal cross-sectional areas. In other words, the linear fillers having equal cross-sectional areas are filled between the twisted-pair wire 32 and the shield layer 33 and between the electric wire bundle 2 and the sheath 3. Further, the fill ratio of the linear fillers (first linear fillers 41) between the twisted-pair wire 32 and the shield layer 33 is greater than the fill ratio of the linear fillers (second linear fillers 42) between the electric wire bundle 2 and the sheath 3. Since each of the first linear fillers 41 and each of the second linear fillers 42 have equal cross-sectional areas, the above-described difference in fill ratios indicates that the number of first linear fillers 41 per unit cross-sectional area differs from the number of second linear fillers 42 per unit cross-sectional area. In other words, the above-described difference in fill ratios indicates that the number of first linear fillers 41 per unit cross-sectional area is greater than the number of second linear fillers 42 per unit cross-sectional area. Note that manufacturing variations may be present in the cross-sectional areas of each of the first linear fillers 41 and each of the second linear fillers 42. The description above in which the first linear fillers 41 and the second linear fillers 42 are described as having equal cross-sectional areas is not intended to exclude such manufacturing variations.

As described above, the composite cable 1 according to the present embodiment has the plurality of first linear fillers 41 filled between the twisted-pair wire 32 and the shield layer 33, and the plurality of second linear fillers 42 filled between the electric wire bundle 2 and the sheath 3. Further, the fill ratio of the first linear fillers 41 is greater than the fill ratio of the second linear fillers 42. In other words, in the composite cable 1 according to the present embodiment, a fill density of the linear fillers inside the shield wire 30 differs from a fill density of the linear fillers outside the shield wire 30, such that the fill density of the linear fillers inside the shield wire 30 is higher than the fill density of the linear fillers on the outer periphery of the shield wire 30. Therefore, the shield wire 30 can be suppressed from being crushed by a pressure of the fillers (second linear fillers 42) which are filled between the sheath 3 and the electric wire bundle 2 that includes the shield wire 30 for maintaining the cross-sectional shape of the entire composite cable 1, and thus, the cross-sectional shape of the shield wire 30 can be suppressed from deformation. In other words, it is possible to suppress deformation of the cross-sectional shape of the shield layer 33 provided on an outer periphery of each of the signal lines 31 while also maintaining the cross-sectional shape of the composite cable 1. Hence, even if the composite cable 1 is repeatedly bent, possibility of ultimate damage to the shield layer 33 can be reduced.

The present invention is not limited to the foregoing embodiment, and various modifications and alterations can be made without departing from the gist and scope of the present invention. For example, in the foregoing embodiment, a shield layer corresponding to the shield layer 33 is not provided on an outer periphery of each of the first electric wires 20. As a result, the first electric wires 20 are in direct contact with the second linear fillers 42. However, there is also an embodiment in which a shield layer corresponding to the shield layer 33 is provided on the outer periphery of each of the first electric wires 20.

Figure 2:
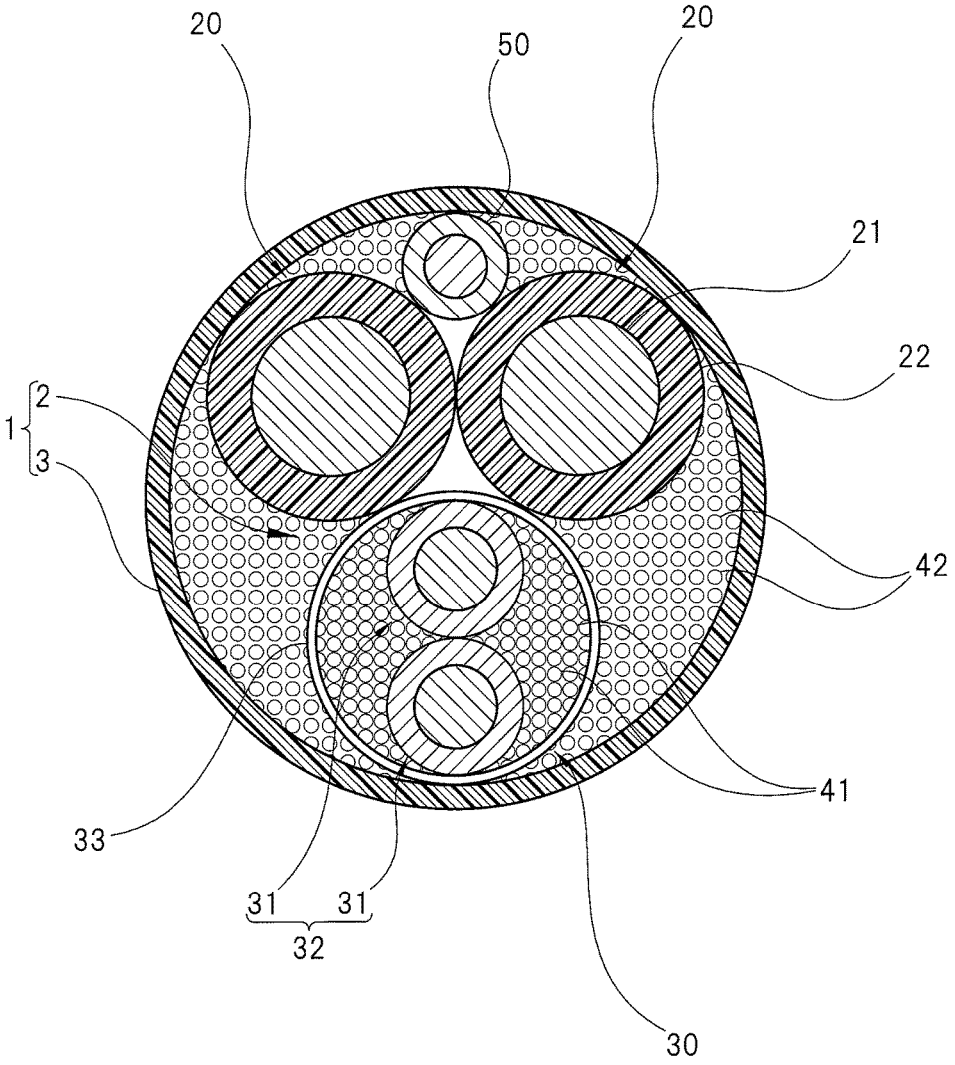
FIG. 2 is a cross-sectional view showing another example of a composite cable to which the present invention is applied.
Figure 3:
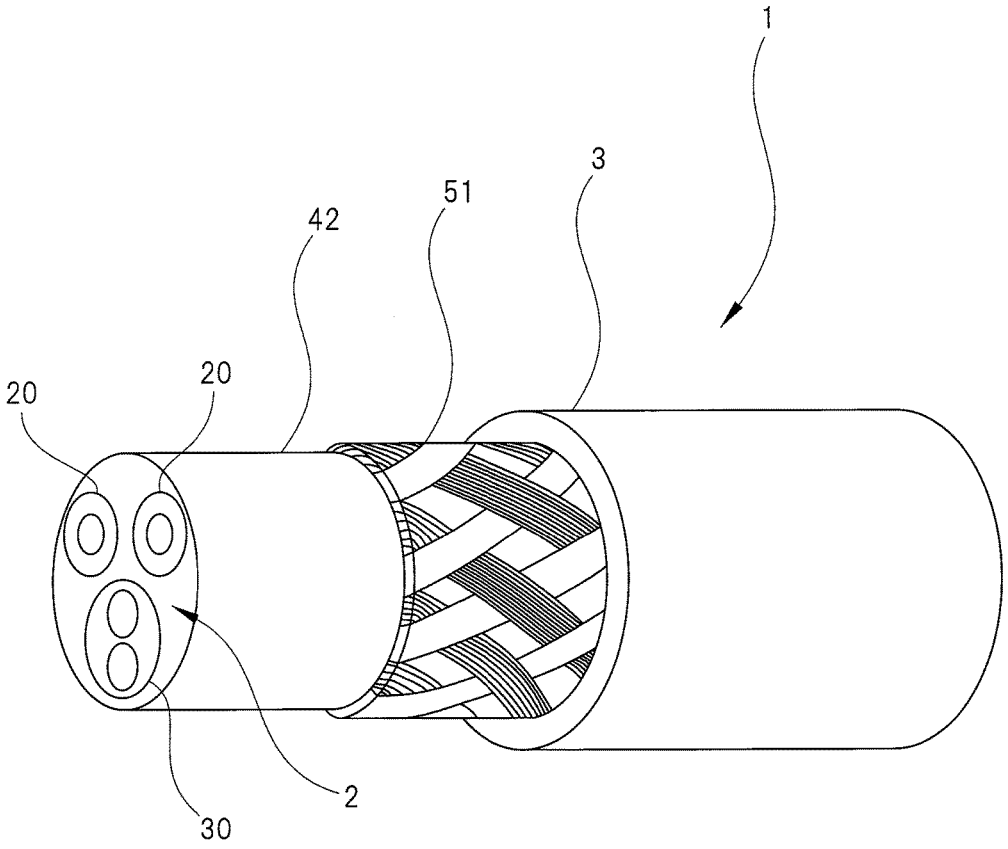
FIG. 3 is a perspective view showing still another example of a composite cable to which the present invention is applied.

There is also an embodiment in which a ground wire 50 is provided as shown in FIG. 2. In addition, there is also an embodiment in which a braided shield 51 is provided inside the sheath 3 as shown in FIG. 3. Note that FIG. 3 shows a cross-sectional structure of the composite cable 1 in a simplified manner.

There is also an embodiment in which each of the first linear fillers 41 or each of the second linear fillers 42 is a yarn, a string or the like formed of a material other than polyethylene, and there is also an embodiment in which each of the first linear fillers 41 or each of the second linear fillers 42 is, for example, a rayon fiber yarn.

There is also an embodiment in which the sheath 3 is formed of a material other than polyurethane (such as ethylene-propylene-diene rubber (EPDM)). There is also an embodiment in which the insulation 22 is formed of a material other than crosslinked polyethylene (such as fluoropolymer resin).

There is also an embodiment in which a press-winding tape that is a non-woven fabric tape or a paper tape is wound around the plurality of first linear fillers 41 or the plurality of second linear fillers 42. In this case, the press-winding tape may be laterally wound or may be longitudinally lapped and wound.

Note that all of the numerical values and numerical ranges in the present specification are described by way of example. In addition, the number or types of electric wires included in the composite cable of the present invention can be added, deleted or replaced as appropriate according to the purpose of the composite cable. Further, the present invention can be applied to a composite cable that is not utilized for a vehicle wiring harness. In fact, the composite cable to which the present invention is applied has an advantageous effect in that the electric wires inside the composite cable are not easily crushed when the composite cable is bent. From such a viewpoint, the present invention is suitable for being applied to a composite cable that is utilized in a situation where bending is repeated, and is suitable for being applied to, for example, a composite cable that is arranged along an arm of an industrial robot and is repeatedly bent according to a movement of the arm.

What is claimed is:

1. A composite cable comprising:

a plurality of first electric wires;

a shield wire including a twisted wire in which a plurality of second electric wires are twisted together and a shield layer provided on an outer periphery of the twisted wire, each of the second electric wires having an outer diameter smaller than each of the first electric wires;

a sheath provided on an outer periphery of a bundle in which the plurality of first electric wires and the shield wire are twisted together;

a plurality of first linear fillers filled between the twisted wire and the shield layer; and a plurality of second linear fillers filled between the bundle and the sheath, wherein each of the first linear fillers and each of the second linear fillers are a same type of linear filler, and a fill ratio of the first linear fillers is greater than a fill ratio of the second linear fillers.

2. The composite cable according to claim 1, wherein the plurality of second linear fillers, the plurality of first electric wires and the shield wire are twisted together, and the plurality of first linear fillers and the plurality of second electric wires are twisted together.

3. The composite cable according to claim 1, wherein each of the first linear fillers and each of the second linear fillers have equal cross-sectional areas, and the number of first linear fillers per unit cross-sectional area is greater than the number of second linear fillers per unit cross-sectional area.

4. The composite cable according to claim 2, wherein each of the first linear fillers and each of the second linear fillers have equal cross-sectional areas, and the number of first linear fillers per unit cross-sectional area is greater than the number of second linear fillers per unit cross-sectional area.

5. The composite cable according to claim 1, wherein the plurality of first electric wires are in direct contact with the plurality of second linear fillers.

6. The composite cable according to claim 2, wherein the plurality of first electric wires are in direct contact with the plurality of second linear fillers.

7. The composite cable according to claim 3, wherein the plurality of first electric wires are in direct contact with the plurality of second linear fillers.

8. The composite cable according to claim 4, wherein the plurality of first electric wires are in direct contact with the plurality of second linear fillers.

* * * * *